US007269976B2

(12) United States Patent
Miyai et al.

(10) Patent No.: US 7,269,976 B2
(45) Date of Patent: Sep. 18, 2007

(54) WEFT KNITTING MACHINE CAPABLE OF SWITCHING MOVING MEMBER BRINGING STATE

(75) Inventors: Takuya Miyai, Wakayama (JP); Norio Kotaka, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 10/574,939

(22) PCT Filed: Oct. 7, 2004

(86) PCT No.: PCT/JP2004/014862

§ 371 (c)(1),
(2), (4) Date: Apr. 7, 2006

(87) PCT Pub. No.: WO2005/035854

PCT Pub. Date: Apr. 21, 2005

(65) Prior Publication Data

US 2007/0056326 A1 Mar. 15, 2007

(30) Foreign Application Priority Data

Oct. 10, 2003 (JP) ..... P2003-352985

(51) Int. Cl.
*D04B 15/48* (2006.01)

(52) U.S. Cl. ..... 66/127

(58) Field of Classification Search ..... 66/125 R, 66/126 R, 127, 128, 129
See application file for complete search history.

(56) References Cited

U.S. PATENT DOCUMENTS 5,109,681 A * 5/1992 Schmid et al. ..... 66/126 R
5,588,311 A * 12/1996 Kiribuchi ..... 66/60 R
6,047,570 A * 4/2000 Shima ..... 66/126 R

FOREIGN PATENT DOCUMENTS

| | | |
|---|---|---|
| DE | 4407708 | 9/1995 |
| JP | 54-21464 | 7/1979 |
| JP | 8-127948 | 5/1996 |
| JP | 3028923 | 9/1996 |
| JP | 9-268455 | 10/1997 |
| JP | 2733627 | 3/1998 |

OTHER PUBLICATIONS

International Search Report (PCT/ISA/210).

* cited by examiner

*Primary Examiner*—Danny Worrell
(74) *Attorney, Agent, or Firm*—Harness, Dickey & Pierce, P.L.C.

(57) ABSTRACT

A yarn feeder can be stopped at a stopping mechanism and attached to and detached from a holder. The holder is fitted to a front end of a holding arm. The carriage-side holding arm is held by a moving member holding mechanism. The moving member holding mechanism includes a bringing state switching mechanism to switch the bringing state of the moving member by the carriage. The bringing state switching mechanism acts on a coupling portion on the carriage side, and can shift the bringing position of the moving member holding mechanism relative to the carriage and perform the switching to a position where the moving member holding mechanism is not brought. A rail is provided such that the yarn feeder's position does not change even when the moving member holding mechanism is separated from the carriage. The rail is installed to be parallel with a needle bed's longitudinal direction.

5 Claims, 15 Drawing Sheets

WEFT KNITTING MACHINE CAPABLE OF SWITCHING MOVING MEMBER BRINGING STATE

TECHNICAL FIELD

The present invention relates to a weft knitting machine in which a moving member for knitting such as a yarn feeding port for performing an operation of supporting to knit a fabric in the weft knitting machine is provided on a moving member holding mechanism such that it is possible to switch a bringing state with respect to the moving member holding mechanism.

BACKGROUND ART

Conventionally, in weft knitting machines, carriages are led to travel back and forth along needle beds. Cam mechanisms that are mounted on the carriages let knitting needles that are arranged side by side along the needle beds selectively perform a knitting operation. The knitting operation is performed from yarn feeding ports that are brought by the carriages. A fabric is knitted by supplying knitting yarns to the knitting needles. In weft knitting machines of a V-shaped bed-type in which front and rear needle beds are facing each other with a needle bed gap interposed therebetween, rails that are referred to as yarn guide rails, for example, are installed above the needle bed gap. Yarn feeding ports are provided at the front ends, facing the needle bed gap, of yarn feeders that can travel along the yarn guide rails, and the carriages bring the yarn feeders and supply knitting yarns to the knitting needles. The yarn feeders are also referred to as yarn carriers. The carriages bring the yarn feeders by providing pins that can project and withdraw at a bridge coupling between the carriages of the front and rear needle beds such that the bridge spans over the yarn guide rails, and by projecting the pins so as to be engaged with bringing recesses that are provided on the yarn feeders.

In ordinary knitting, while a fabric is knitted, a knitting yarn is fed from the yarn feeding port to the knitting needle at a point midway in a process in which the knitting needle has moved backward from a position obtained when the knitting needle moves forward from the needle bed into the needle bed gap to the extent possible. Thus, the yarn feeding position at which a knitting yarn is fed to a substantially mountain-shaped knitting cam that is mounted on the carriage is the position of the mountain base on the sides that are different from each other in accordance with a direction in which the carriage travels. The yarn feeding positions that are different from each other in accordance with a direction in which the carriage travels can be accepted by extending the bringing recess that is provided on the yarn feeder. More specifically, when the carriage travels in one direction, the yarn feeder is brought by letting the pin abut against the end portion on the one side on the bringing recess, and when the carriage travels in the other direction, the yarn feeder is brought by letting the pin abut against the end portion on the other side on the bringing recess, and thus it is possible to bring the yarn feeder at the position that is shifted in accordance with a direction in which the carriage travels.

There are cases in which the timing at which a knitting yarn is fed for knitting a fabric is made different from that in the ordinary knitting described above. For example, in inlay knitting, a cam for letting a knitting needle perform a knitting operation before an ordinary knitting cam is mounted on the carriage, and in accordance with the cam, a knitting yarn is fed before the timing at which a knitting yarn is fed for knitting an ordinary course. As a knitting yarn for inlay knitting, an elastic yarn that is referred to as a rubber yarn, for example, is used. Furthermore, in plating knitting, a knitting yarn is fed later than the timing at which a knitting yarn is fed for knitting an ordinary course. The yarn feeders used for inlay knitting and plating knitting have bringing recesses that are different in length from that of a yarn feeder used for ordinary knitting.

It should be noted that it is possible to make a yarn feeder capable of being used both for ordinary knitting and for knitting with a shifted timing, by increasing the number of pins that bring the yarn feeder (see German Unexamined Patent Publication DE4407708, Japanese Registered Utility Model Publication JP-Y2 3028923, and Japanese Examined Patent Publication JP-B2 2733627, for example).

German Unexamined Patent Publication No. 4407708 has disclosed, in FIG. 1, a configuration in which two bringing pins that are arranged with a spacing interposed therebetween are provided, the yarn feeder is brought by the bringing pin on the preceding side during inlay knitting, and the yarn feeder is brought by the bringing pin on the following side during ordinary knitting. Furthermore, in FIG. 2, a configuration has been disclosed in which a plurality of bringing recesses are provided on the yarn feeder, and inlay knitting and ordinary knitting are switched by changing the position of the bringing recess with which the bringing pin is engaged.

JP-Y2 3028923 has disclosed a configuration in which two bringing pins are provided, and the bringing pin on the preceding side is used for ordinary knitting, and the bringing pin on the following side is used for plating knitting. JP-B2 2733627 has disclosed a configuration in which the carriages that are provided on the front and rear needle beds can be moved independently of each other.

In a case where a knitting object is a knitting fabric with a small width, such as gloves, the distance over which the carriage moves along the needle bed is short, but the frequency at which the movement direction is changed becomes high. Examples of an operation of the knitting needle accompanying the travel of the carriage include an operation not requiring a knitting yarn to be fed, such as stitch transfer. In a travel for such an operation, it is not necessary to bring the yarn feeder or other components. In a configuration in which a bringing pin that can project and withdraw is projected to be engaged with the bringing recess on the side of the yarn feeder, it is possible not to bring the yarn feeder by not projecting the bringing pin.

Since the number of yarn guide rails and the number of yarn feeders that can be arranged on each of the yarn guide rails are limited, when yarn feeders are prepared for inlay knitting and plating knitting, in addition to ordinary knitting such that it is possible to perform each type of knitting, the number of yarn feeders that are used for ordinary knitting becomes small, and thus the degree of freedom for using knitting yarns for various purposes decreases.

When the yarn feeder is shared between ordinary knitting and inlay knitting in a configuration as in FIG. 1 of DE4407708, or when the bringing pin for ordinary knitting and the bringing pin for plating knitting are provided in a configuration as in JP-Y2 3028923, the number of bringing pins and control means is doubled, and thus the structure becomes complicated, so that it is impossible to make the carriage lighter. In a configuration as in FIG. 2 of DE4407708, it is necessary to provide a yarn feeder with a plurality of bringing recesses, and thus the yarn feeder becomes large, so that the yarn feeder is not appropriate for a knitting machine in which a fabric with a small width, such as gloves, is knitted by frequently repeating back and forth travels. Even when in a configuration as in FIG. 3 of JP-B2 2733627, for example, yarn guiding rod hook member supporting arms (bridges) that are provided with bringing pins are separated between the front and rear carriages, the carriages cannot be mounted on and dismounted from the yarn guiding rod hook member supporting arms (bridges) in a state where the yarn feeders are engaged, and thus it is impossible to make the carriages lighter nor to improve the knitting efficiency.

In a configuration in which for the yarn feeders provided on the yarn guide rails, the bringing pins are provided on the bridge coupling between the carriages on the front and rear needle beds, even in a case where the bringing pins are not projected and thus the yarn feeders are not brought by the carriages, it is not likely that the mass of the carriages when moving is reduced. When the mass of the carriages can be reduced in a state where it is not necessary to bring moving members for knitting such as the yarn feeders, it is possible to improve the productivity by saving the energy for driving the carriages and by increasing the driving speed in a case where a fabric with a small width is knitted at a high frequency of traveling back and forth.

DISCLOSURE OF INVENTION

It is an object of the invention to provide a weft knitting machine capable of switching a moving member bringing state in which a bringing state of the moving member for knitting can be switched as appropriate.

The invention is directed to a weft knitting machine capable of switching a bringing state of a moving member for knitting which moves while being brought by at least one of front and rear carriages which, while moving along front and rear needle beds of the weft knitting machine, let knitting needles arranged side by side in each of the needle beds perform a knitting operation, the moving member for knitting a fabric in cooperation with the knitting needles, comprising:

a rail that is disposed along the needle beds;

a stopping mechanism that is disposed at an end portion of the needle beds, and that can stop the moving member for knitting;

a moving member holding mechanism that can move back and forth on the rail, the stopping mechanism being capable of attaching the moving member for knitting to the moving member holding mechanism and detaching the moving member for knitting from the moving member holding mechanism when the moving member holding mechanism moves to a position of the stopping mechanism; and a bringing state switching mechanism capable of switching between a state in which the moving member holding mechanism is brought by the carriage and a state in which the moving member holding mechanism is not brought.

Furthermore, the invention is characterized in that:

the bringing state switching mechanism is provided on each of the front and rear carriages, and the bringing state switching mechanisms can make bringing positions different from each other between the front and rear carriages.

Furthermore, the invention is characterized in that the bringing state switching mechanism includes:

a control member that is provided on either one of the moving member holding mechanism and the carriage, and that can control an actuation state between actuation and non-actuation, a bringing member that is provided on the other one of the moving member holding mechanism and the carriage, and that can be brought at bringing positions that are different from each other in accordance with a direction in which the carriage travels when the control member is actuated, and cannot be brought when the control member is not actuated, an operation bar that is provided along the rail, and that can be displaced in a direction different from a direction along the rail, and a displacement driving mechanism for displacing the operation bar in the direction different from the direction along the rail, and that the bringing state switching mechanism controls the actuation state of the control member in conjunction with a displacement of the operation bar in the direction different from the direction along the rail, and performs switching of the bringing positions of the moving member holding mechanism with respect to the carriage and switching to a state in which the moving member holding mechanism is not brought.

Furthermore, the invention is characterized in that the actuation state of the control member can be controlled such that the control member projects toward the bringing member in the actuation, and does not project toward the bringing member in the non-actuation, and the bringing member has a recess portion that abuts against the control member projecting in the actuation at bringing positions that are different from each other in accordance with a direction in which the carriage moves.

Furthermore, the invention is characterized in that the actuation state can be controlled such that the control member projects toward the bringing member in the actuation at bringing positions that are different from each other in accordance with a direction in which the carriage moves, and does not project toward the bringing member in the non-actuation, and the bringing member has a protrusion portion that abuts against the control member projecting in the actuation.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Figure 1:
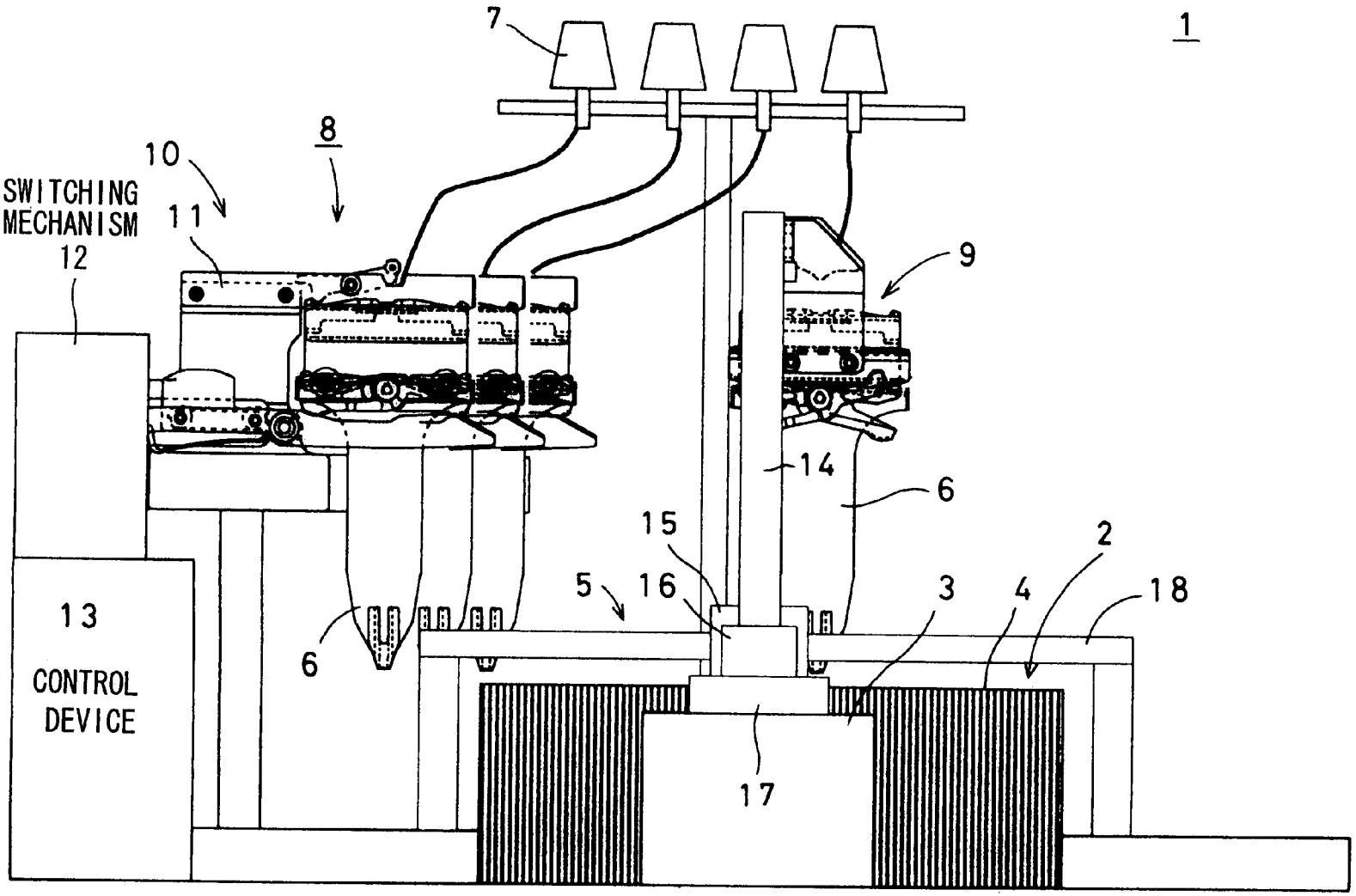
FIG. 1 is a simplified front view of a weft knitting machine 1 according to an embodiment of the invention.

Now referring to the drawings, preferred embodiments of the invention are described below.

Figure 2:
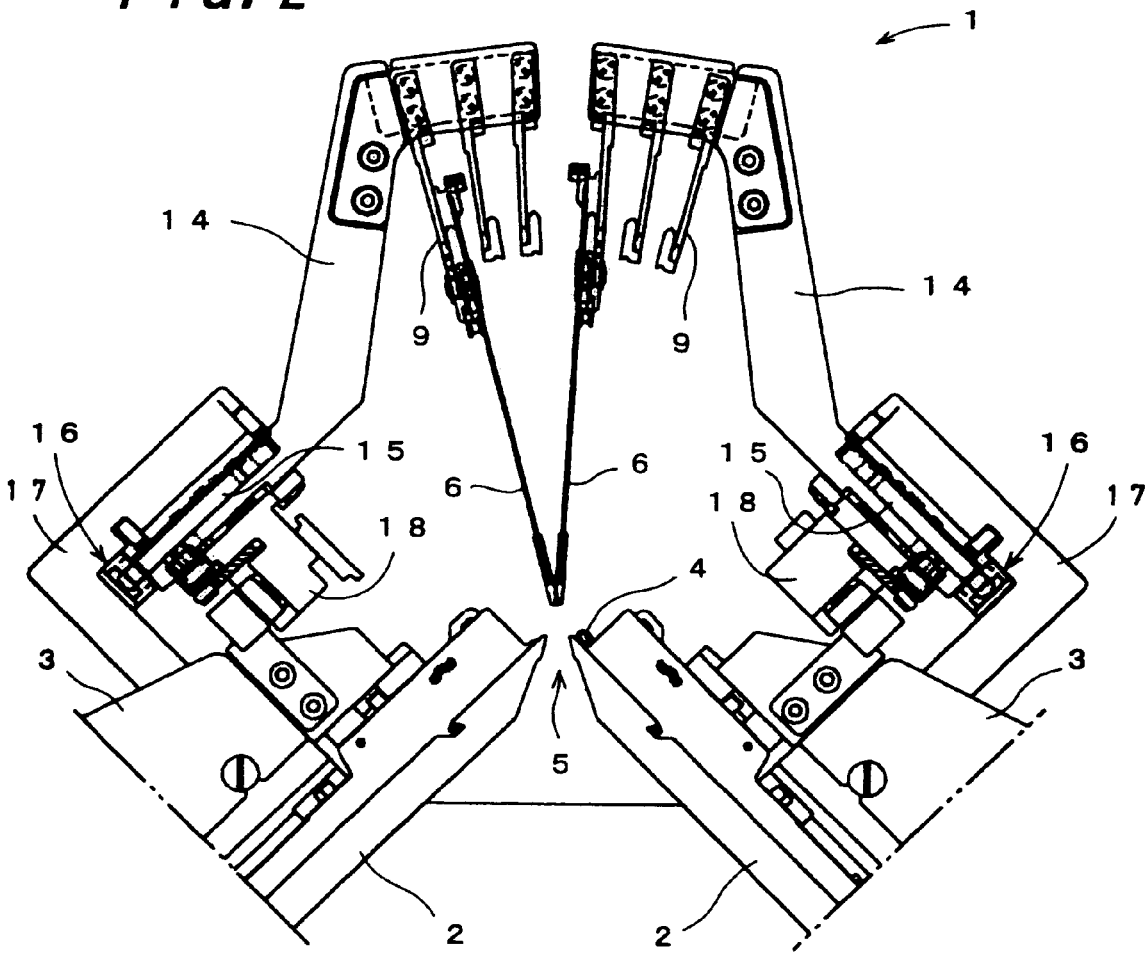
FIG. 2 is a right side view of the weft knitting machine 1 in FIG. 1.
Figure 3:
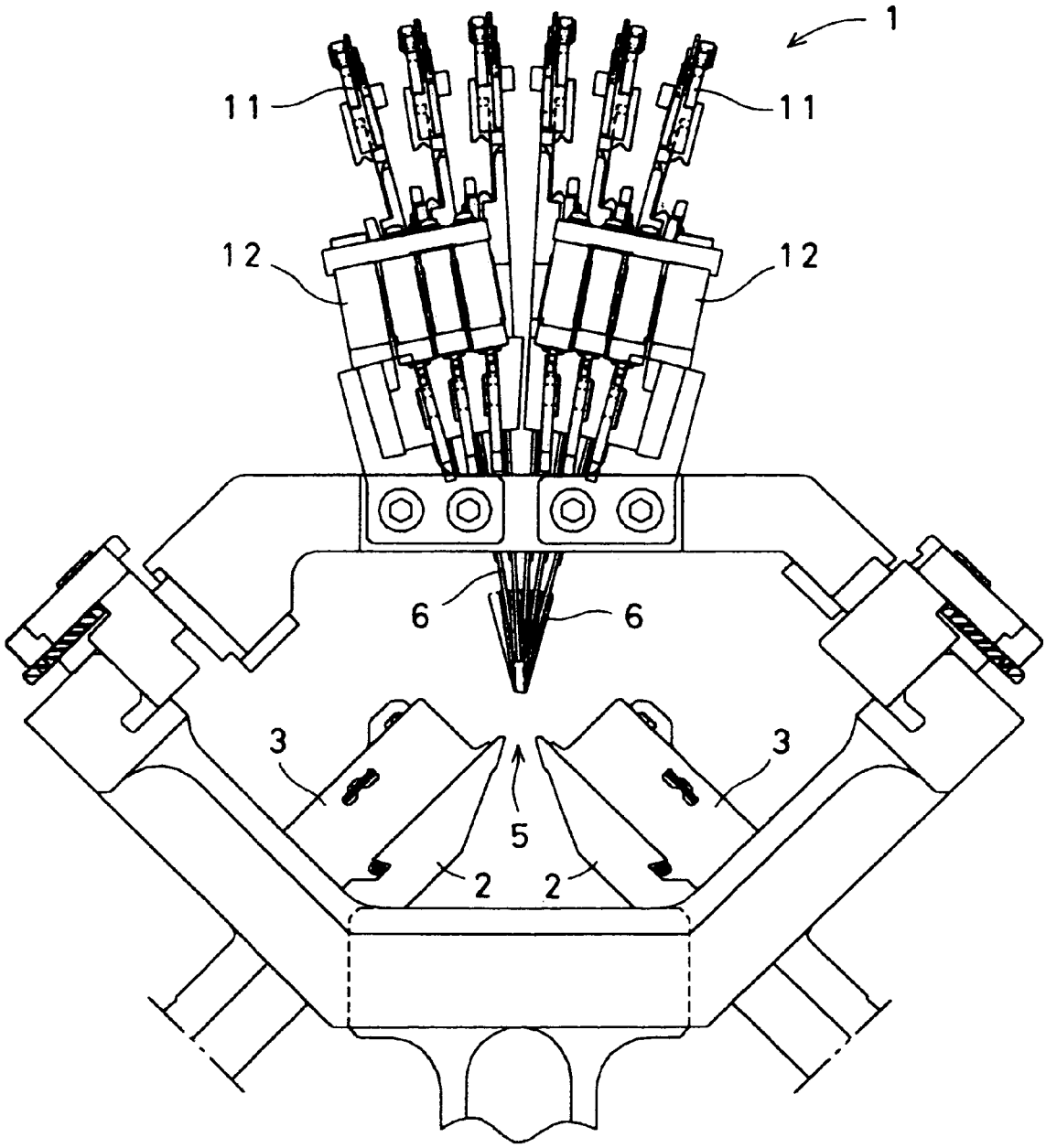
FIG. 3 is a left side view of the weft knitting machine 1 in FIG. 1.

FIGS. 1, 2, and 3 show a schematic configuration of a weft knitting machine 1 according to an embodiment of the invention. FIG. 1 shows a front view, FIG. 2 shows a right side view, and FIG. 3 shows a left side view. In the weft knitting machine 1, a fabric is knitted while carriages 3 are led to travel back and forth along needle beds 2. As the needle beds 2, a pair of needle beds of the front and the rear are provided. On each of the needle beds 2, a large number of knitting needles 4 are arranged side by side, and selectively perform an operation of moving forward into and backward from a needle bed gap 5 in which the front and rear needle beds 2 are opposed to each other, by receiving an action of knitting cams that are mounted on the carriages 3. The weft knitting machine 1 is a weft knitting machine of a V-shaped bed-type in which the pair of needle beds 2 of the front and the rear are opposed to each other with the needle bed gap 5 interposed therebetween, and one of a plurality of yarn feeders 6 is selectively brought to the carriage 3. The yarn feeders 6 are typical moving members for knitting, and can knit a fabric by, while moving in a constant positional relationship with respect to the carriages 3, supplying knitting yarns to the knitting needles 4, thereby repeatedly forming knitting loops. It is possible to feed knitting yarns respectively from yarn feeding apparatuses 7 to the yarn feeders 6.

The weft knitting machine 1 is provided with a knitting member switching apparatus 8 in order to switch knitting yarns that are used for knitting by switching the plurality of yarn feeders 6. The knitting member switching apparatus 8 includes a plurality of holders 9 that are provided on the side of the carriages 3 and a stopping device 10 that is provided on the end portion such as the left side end on the needle beds 2. The stopping device 10 includes a plurality of stopping mechanisms 11 and switching mechanisms 12 in correspondence with the holders 9, and is further provided with a control device 13 for letting the carriages 3 travel and for selecting the knitting needles 4, for example, based on knitting data for knitting a fabric.

As shown in FIGS. 2 and 3, the plurality of holders 9 are mounted on holding arms 14. The stopping mechanisms 11 and the switching mechanisms 12 are arranged in accordance with the position on which the holders 9 are mounted. As shown in FIG. 1, the holding arms 14 on the side of the carriages 3 are held by moving member holding mechanisms 15. The moving member holding mechanisms 15 are provided with bringing state switching mechanisms 16, and can switch a bringing state between the moving member holding mechanisms 15 and the carriages 3. The bringing state switching mechanisms 16 act on coupling portions 17 on the side of the carriages 3, and can shift the bringing position of the moving member holding mechanisms 15 with respect to the carriages 3 and can perform switching to a position in which the moving member holding mechanisms 15 are not brought, as described later. Rails 18 are provided such that the position of the yarn feeders 6, for example, does not change even when the moving member holding mechanisms 15 are separated from the carriages 3. The rails 18 are installed so as to be in parallel with the longitudinal direction of the needle beds 2 along the needle bed gap 5.

Figure 4:
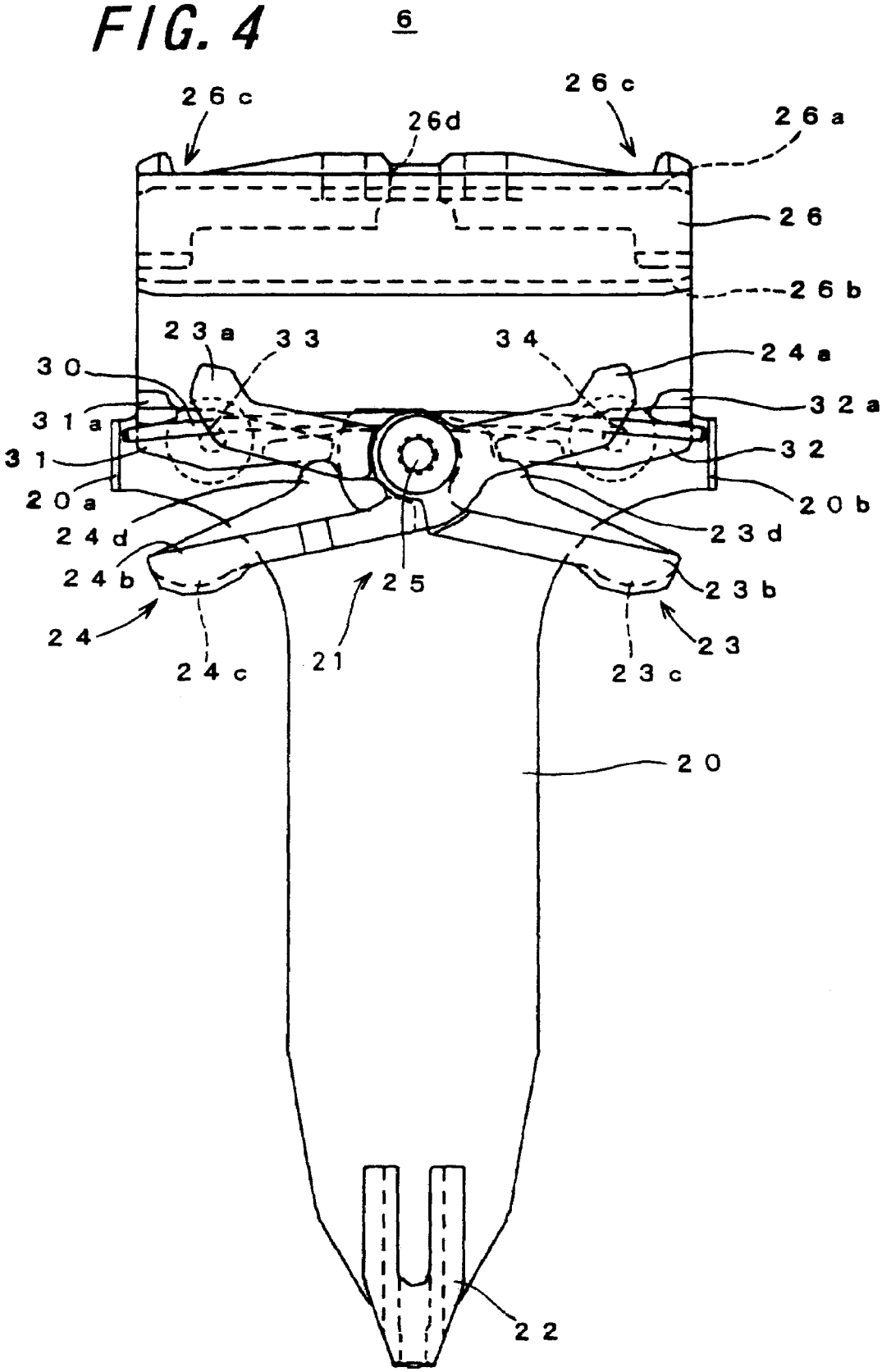
FIG. 4 is a front view of a yarn feeder 6 in FIG. 1.

FIG. 4 shows the configuration of the yarn feeder 6 shown in FIGS. 1 to 3. The yarn feeder 6 is provided with a hook mechanism 21 on the base end side of a base 20 in the shape of a rod, and a yarn feeding port 22 on the front end side. The hook mechanism 21 is provided with a pair of levers 23 and 24 and a swinging shaft 25. A guide member 26 is fixed at the end of the base end portion of the base 20. The upper and lower portions of the guide member 26 are respectively provided with grooves 26*a* and 26*b*. The upper portion is also provided with recesses 26*c* that are to be locked with the stopping mechanism 11.

The pair of levers 23 and 24 of the hook mechanism 21 intersect each other in the middle in the shape of an X, and can be swingingly displaced around the swinging shaft 25 that is inserted into the intersecting portion. One end sides 23*a* and 24*a* of the levers 23 and 24 have protrusions that can be hooked on the holder 9. An external force can act on other end sides 23*b* and 24*b* of the levers 23 and 24. Grooves 23*c* and 24*c* are formed respectively on the portions for receiving an external force, on the other end sides 23*b* and 24*b*. It is possible to switch a hook state and a non-hook state with respect to the holder 9, by opening and closing the one end sides 23*a* and 24*a*, with application of an external force between the other end sides 23*b* and 24*b* of the pair of levers 23 and 24.

A wire spring 30 is also disposed adjacent to the hook member 21. The wire spring 30 is made of an elastic material such as a piano wire, both ends thereof are guided by protrusions 31*a* and 32*a* of a pair of swinging pieces 31 and 32 that are provided on both sides in the width direction of the base 20, and bending portions 20*a* and 20*b* of the base 20, and the middle portion is curved using the intersecting portion of the levers 23 and 24 as a supporting point such that both ends can move resiliently. Swinging supporting points 33 and 34 are provided respectively in the middle portions of the swinging pieces 31 and 32. The levers 23 and 24 of the hook mechanism 21 are respectively provided with pressing portions 23*d* and 24*d* for receiving a pressing force from the wire spring 30 between the swinging shaft 25 and the other end sides 23*b* and 24*b*. When an external force acts on the other end sides 23*b* and 24*b* of the levers 23 and 24, the levers 23 and 24 are swingingly displaced around the swinging shaft 25, the pressing portions 23*d* and 24*d* of the levers 23 and 24 press the swinging pieces 31 and 32, the swinging pieces 31 and 32 swing using the swinging supporting points 33 and 34 as the axes, and thus the wire spring 30 is curved. The wire spring 30, which is biasing means, biases between the other end sides 23*b* and 24*b* of the levers 23 and 24 of the hook mechanism 21, which is hook means, such that the one end sides 23*a* and 23*b* of the levers 23 and 24 move closer to each other. Thus, when the one end sides 23*a* and 24*a* of the levers 23 and 24 are hooked on the holder 9 in a direction in which the one end sides 23*a* and 24*a* are closed, it is possible to keep a hook state with a biasing force of the spring.

Figure 5:
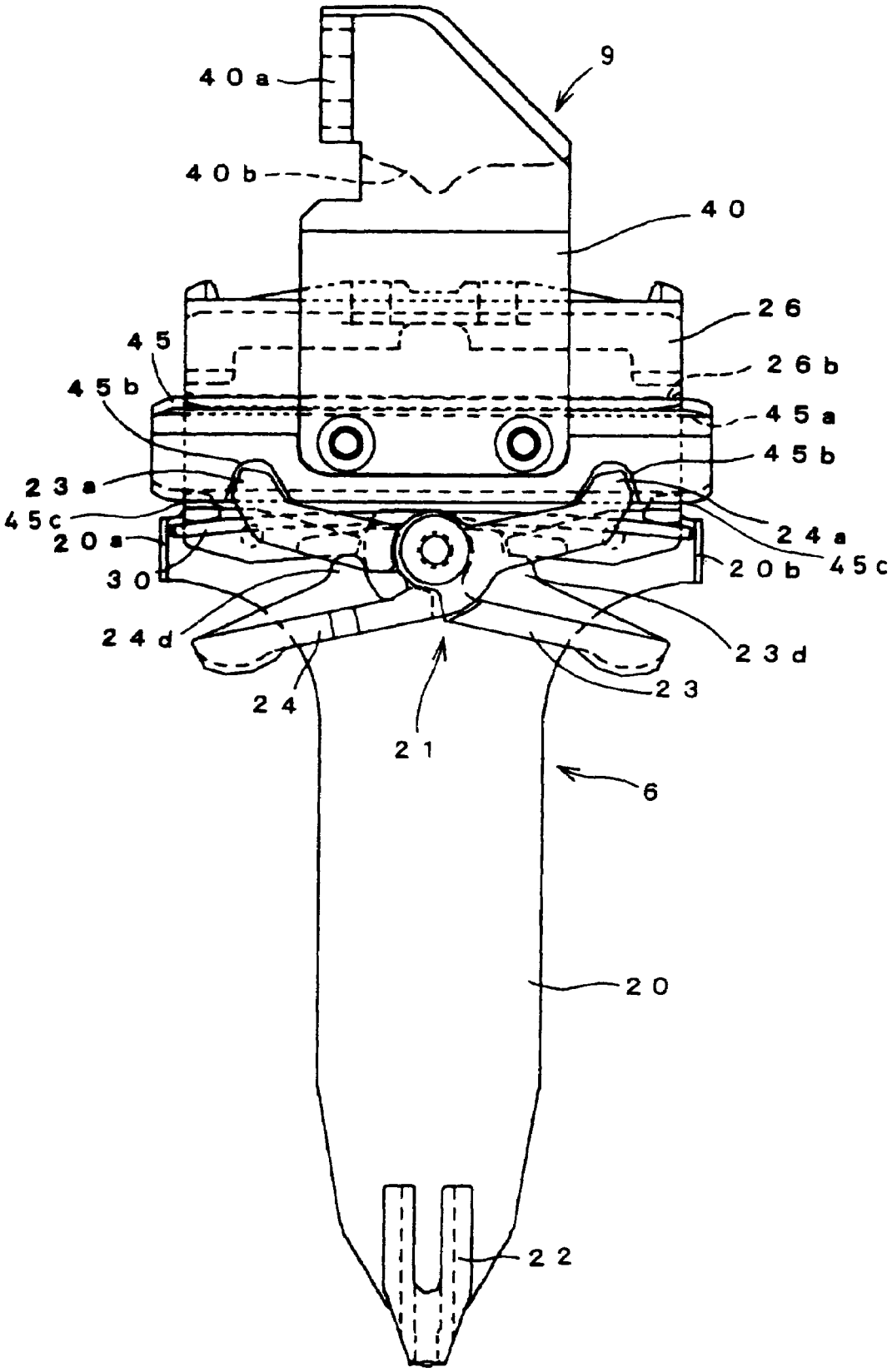
FIG. 5 is a front view showing a state in which the yarn feeder 6 in FIG. 1 is hooked on a holder 9.

FIG. 5 shows a state in which the yarn feeder 6 is hooked on the holder 9. The holder 9 includes an attachment member 40 and a support member 45. The attachment member 40 has an attachment portion 40*a* that is to be attached to the holding arm 14 in FIGS. 1 to 3, and a cam groove 40*b* for unlocking the yarn feeder 6 from the recess 26*c* of the guide member 26. The support member 45 has a ridge 45*a* that is fitted to the groove 26*b* on the lower side on the guide member 26, recesses 45*b* on which the one end sides 23*a* and 24*a* of the levers 23 and 24 of the yarn feeder 6 are hooked, and pressing portions 45*c* for actuating the switching mechanism 12 provided on the stopping mechanism 11. With a biasing force applied when the wire spring 30 presses the pressing portions 23*d* and 24*d* of the levers 23 and 24, the yarn feeder 6 can keep a state in which the one end sides 23*a* and 24*a* of the pair of levers 23 and 24 of the hook mechanism 21 are hooked on the recesses 45*b* of the support member 45 of the holder 9.

Figure 6:
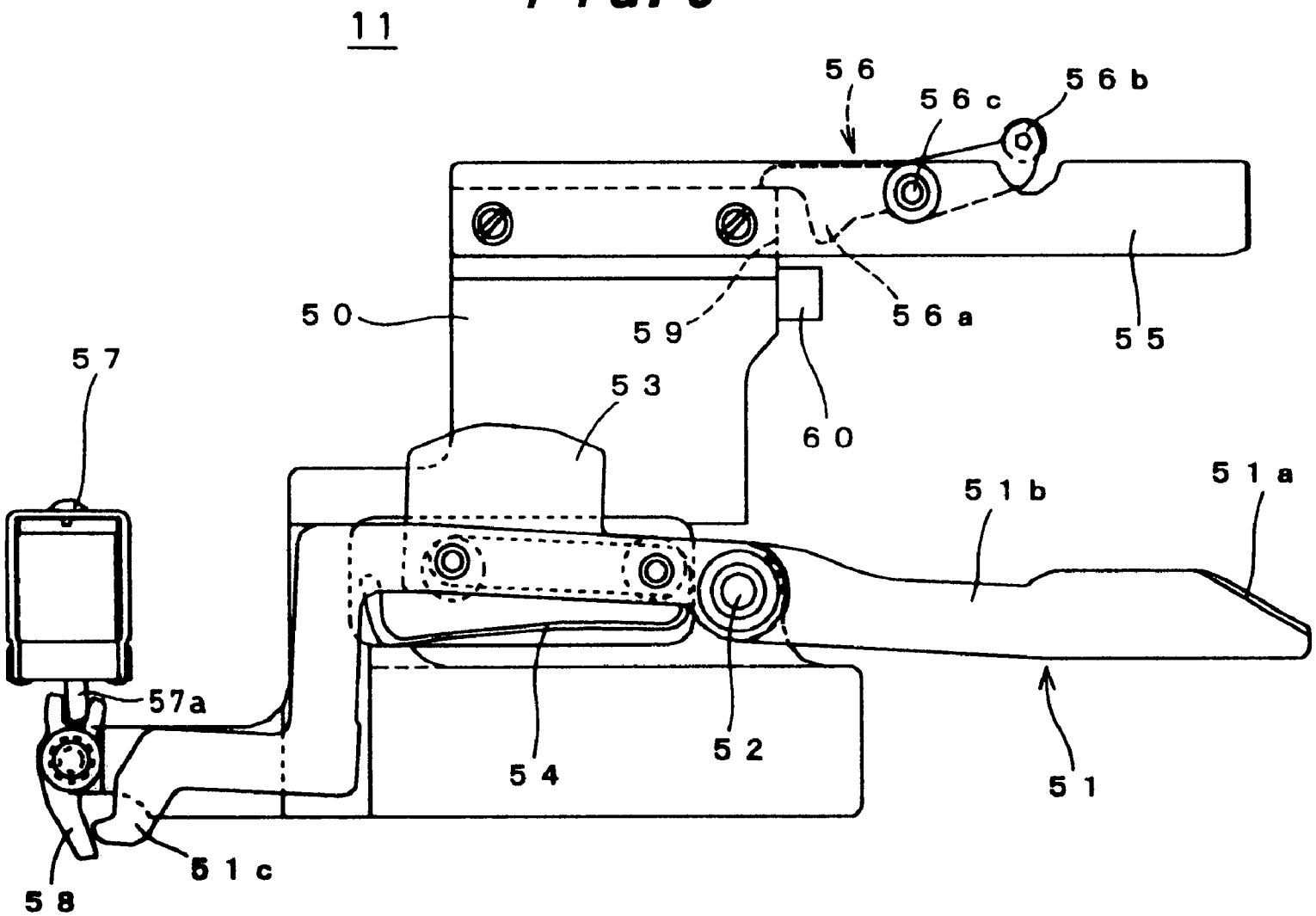
FIG. 6 is a front view showing a state in which an external force for switching a hook mechanism 21 of the yarn feeder 6 to a non-hook state does not act in a stopping mechanism 11 in FIG. 1.
Figure 7:
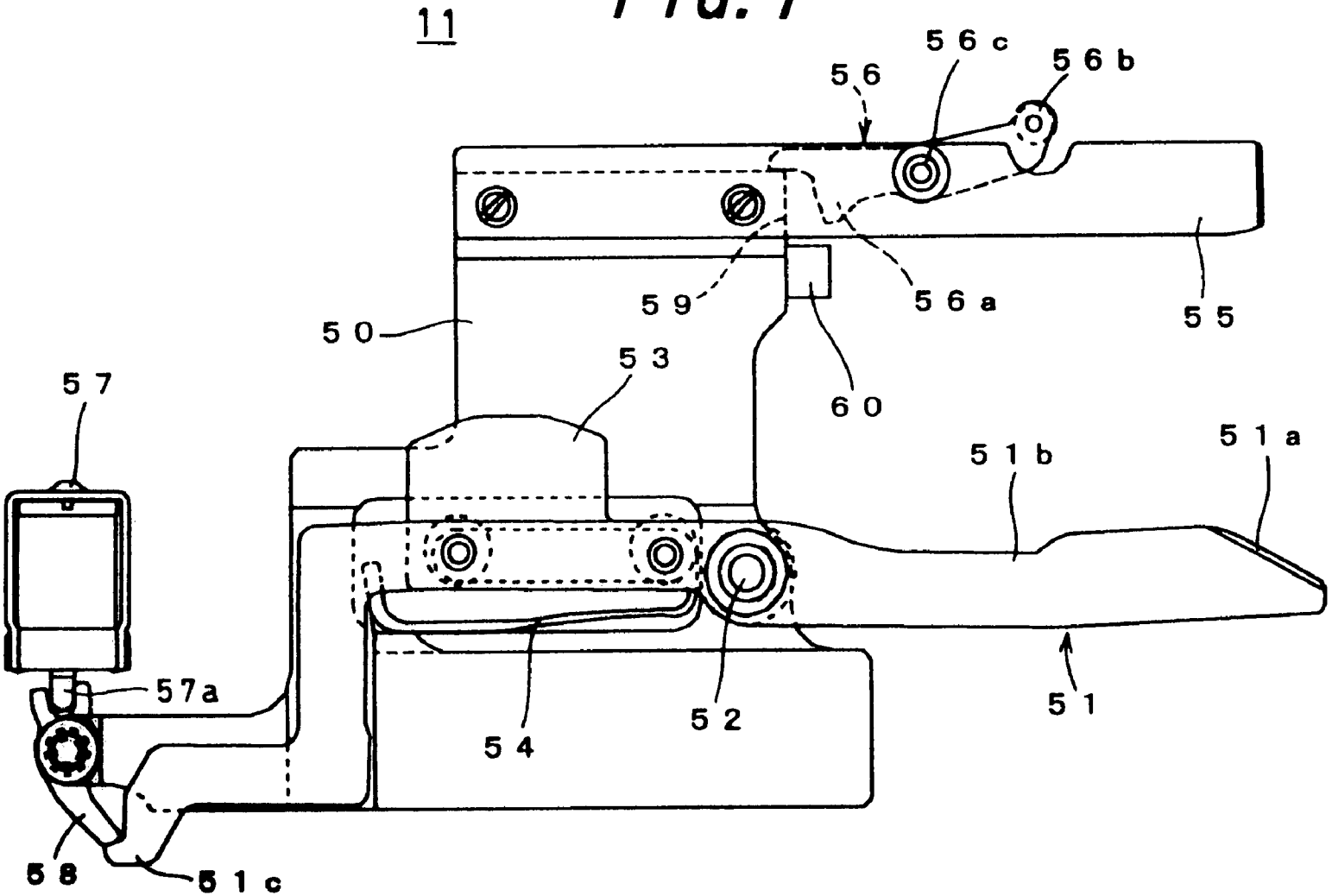
FIG. 7 is a front view showing a state in which an external force for switching the hook mechanism 21 of the yarn feeder 6 to a non-hook state acts in the stopping mechanism 11 in FIG. 1.

FIGS. 6 and 7 show the configuration of the stopping mechanism 11 shown in FIGS. 1 and 3 viewed from the front. FIG. 6 shows a state in which an external force for switching the hook mechanism 21 of the yarn feeder 6 to a non-hook state does not act, and FIG. 7 shows a state in which lock is performed such that an external force for switching the hook mechanism 21 to a non-hook state acts. In each stopping mechanism 11, a stopping control lever 51 projects from the lower portion of a frame 50 that is provided upright from the needle bed 2 shown in FIGS. 1 to 3, along the path at which the carriage 3 arrives. The stopping control lever 51 can slidingly abut from the below against the other end sides 23*b* and 24*b* of the levers 23 and 24 of the hook mechanism 21 of the yarn feeder 6 that is hooked on the holder 9 attached to the carriage 3. An inclination portion 51*a* is provided on one side of the stopping control lever 51, and the upper end of the inclination portion 51*a* is fitted to the grooves 23*c* and 24*c* of the other end sides 23*b* and 24*b* of the levers 23 and 24.

The stopping control lever 51 can be swingingly displaced around a swinging shaft 52 that is provided in the middle. A recess 51*b* is provided between the inclination portion 51*a* and the swinging shaft 52. On the stopping control lever 51, a lock portion 51*c* is provided on the other side that is different from the one side having the inclination portion 51*a*, with the swinging shaft 52 interposed therebetween. A force receiving member 53 is attached between the lock portion 51*c* and the swinging shaft 52. A spring 54 biases the force receiving member 53 such that the force receiving member 53 projects upward. The biasing force of the spring 54 acts from the force receiving member 53 to the stopping control lever 51, so that the stopping control lever 51 is in a direction in which the inclination portion 51*a* does not apply an external force to the other end sides 23*b* and 24*b* of the levers 23 and 24.

A stopping lever 55 projects from the upper portion of the frame 50 such that the stopping lever 55 extends along the path on which the carriage 3 travels, substantially in parallel with the stopping control lever 51. A stopper catch 56 is provided in the middle of the stopping lever 55, and a catch portion 56*a* on one end side can be hooked on the recess 26*c* of the guide member 26 of the yarn feeder 6. When a roller 56*b* on the other end is guided along the cam groove 40*b* provided on the attachment member 40 of the holder 9, the stopper catch 56 is swingingly displaced using a swinging shaft 56*c* in the middle as a supporting point, and thus the catch portion 56*a* on the one end side of the stopper catch 56 is unhooked from the yarn feeder 6 while the holder 9 passes by the stopping mechanism 11.

When a lock piece 58 whose inclination can be switched by an actuation piece 57*a* of a bistable solenoid 57 abuts against the lock portion 51*c* of the stopping control lever 51, the force receiving member 53 is pressed, then the stopping control lever 51 presses the other end sides 23*b* and 24*b* of the levers 23 and 24 of the hook mechanism 21, and thus lock to a state in which the hook mechanism 21 is shifted to a non-hook state is possible. The excitation of the solenoid 57 can be performed from the control device 13 in FIG. 1. When the solenoid 57 is excited in the reverse direction, it is possible to swingingly displace the lock piece 58 in the reverse direction, and thus the stopping control lever 51 can be unlocked.

In the stopping mechanism 11, the stopper catch 56 is unhooked from the yarn feeder 6 by the cam groove 40*b*, but when the pressing portion 45*c* of the holder 9 moves to the position at which the pressing portion 45*c* presses the force receiving member 53, a stopper portion 59 can prevent the yarn feeder 6 from moving. When the yarn feeder 6 moves to the position of the stopper portion 59, it is possible to detect the yarn feeder 6 with a sensor 60 such as a proximity sensor. The detection output of the sensor 60 is input to the control device 13 in FIG. 1. In the weft knitting machine 1, the position of the carriages 3 with respect to the needle beds 2 is always detected, but when the position of the yarn feeder 6 is directly detected, it is possible to confirm the position of the yarn feeder 6 more reliably.

Figure 8:
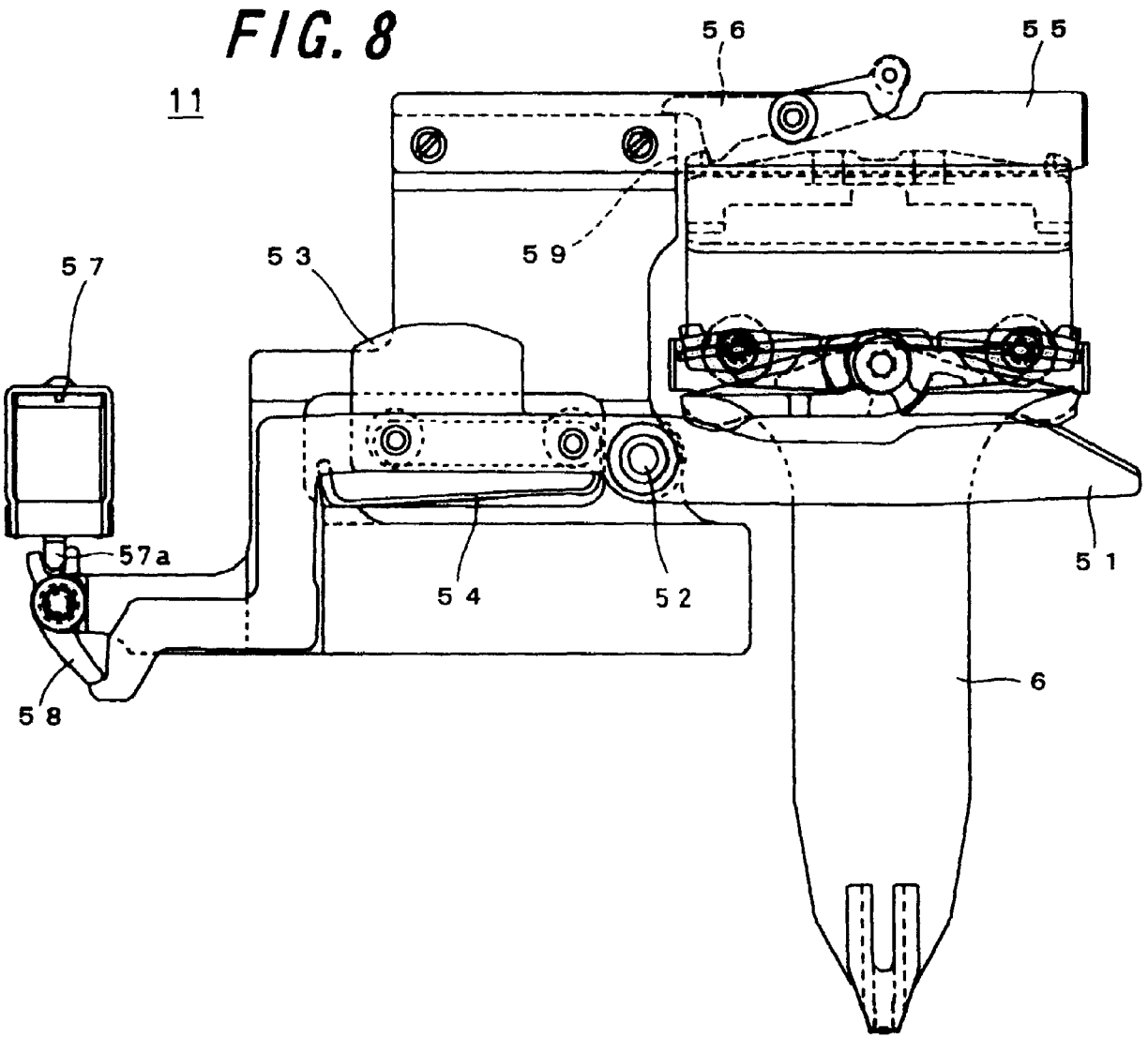
FIG. 8 is a front view showing a stopping state in which the yarn feeder 6 is hooked on a stopper catch 56 in the stopping mechanism 11 in FIG. 1.

FIG. 8 shows a stopping state in which the yarn feeder 6 is hooked on the stopping mechanism 11 with the stopper catch 56. The stopping state can be kept with the hooking of the stopper catch 56 on the recess 26*c* of the guide member 26 of the yarn feeder 6.

Figure 9:
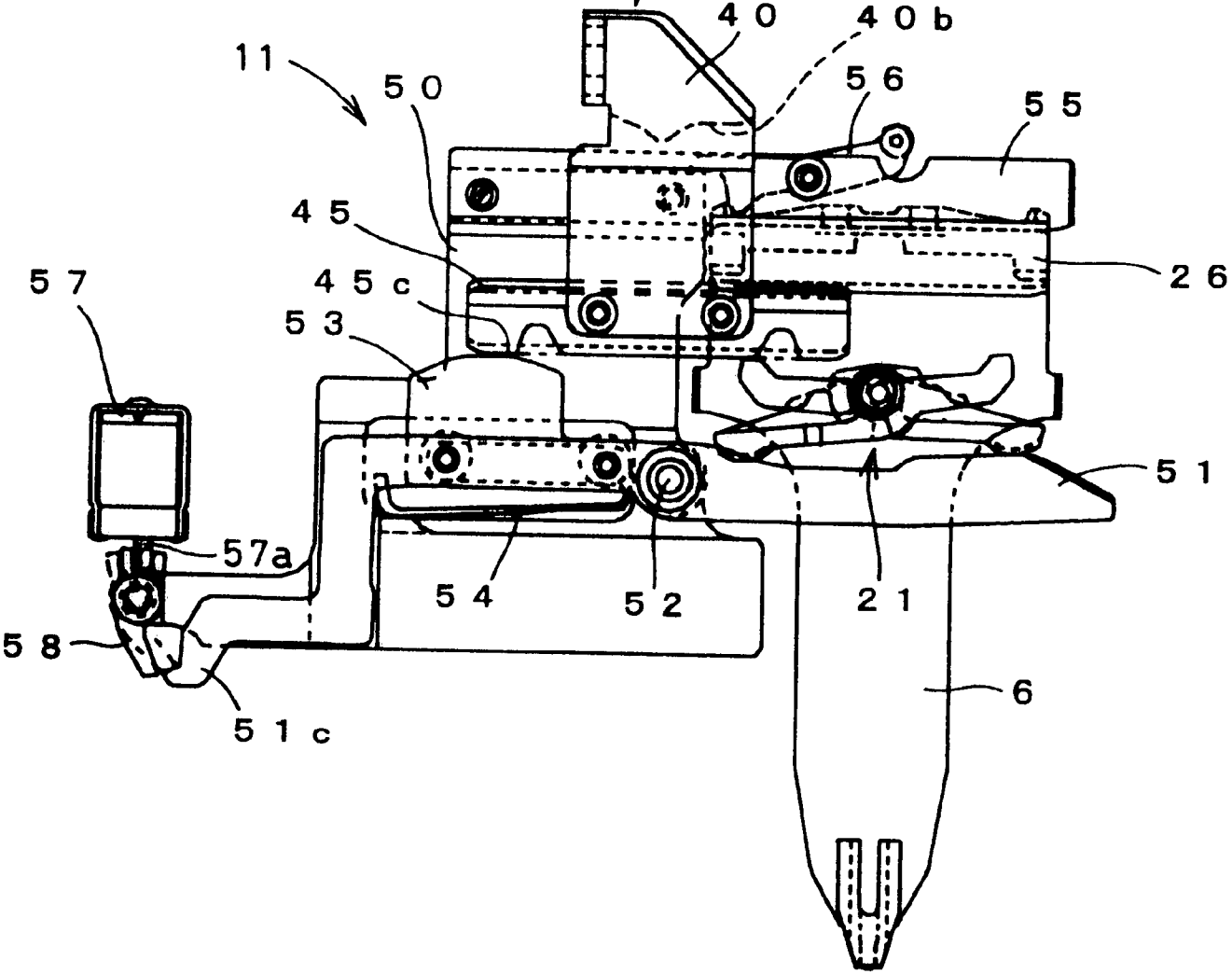
FIG. 9 is a front view showing a state in which the holder 9 in FIG. 1 advances into the stopping mechanism 11 and moves to the position at which a pressing portion 45*c* of a support member 45 surmounts and presses a force receiving member 53.

FIG. 9 shows a state in which the holder 9 is led to advance into the stopping mechanism 11 by continuing the travel of the carriage 3 from the right in the drawing. Even in a state where the yarn feeder 6 is hooked on the holder 9, the yarn feeder 6 is stopped at the position at which the yarn feeder 6 abuts against the stopper portion 59. The hook mechanism 21 is unhooked from the support member 45, and only the holder 9 moves separately from the yarn feeder 6. When the holder 9 is moved to the position at which the pressing portion 45*c* of the support member 45 surmounts and presses the force receiving member 53, the lock portion 51*c* of the stopping control lever 51 is positioned away from the front end position in the swinging displacement of the lock piece 58 with the solenoid 57, and thus it is possible to switch a lock state by exciting the solenoid 57.

Figure 10:
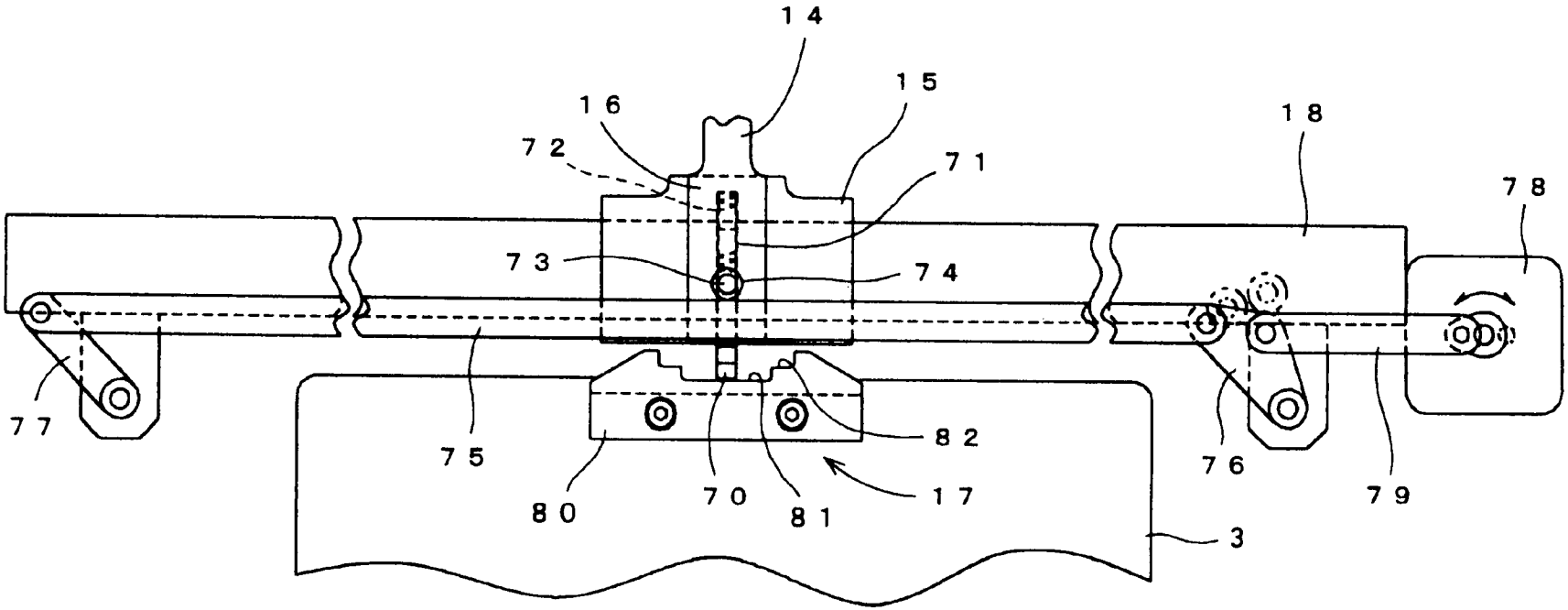
FIG. 10 is a front view outlining a configuration relating to a bringing state switching mechanism 16 and a coupling portion 17 in FIG. 1.

FIG. 10 outlines a configuration relating to the bringing state switching mechanism 16 and the coupling portion 17 in FIG. 1. The bringing state switching mechanism 16 is provided with a bringing pin 70, which is a projecting member that can change the amount by which the bringing pin 70 projects toward the carriage 3. The bringing pin 70 is accommodated in a pin accommodating hole 71, and a spring 72 biases the bringing pin 70 to a direction in which the bringing pin 70 projects from the pin accommodating hole 71 toward the carriage 3. An arm 73 is provided in the vicinity of the position at which a biasing force of the spring 72 is received by the bringing pin 70, and a roller 74 is provided at the front end of the arm 73. The roller 74 abuts against an operation bar 75. The operation bar 75 forms a parallelogram link, so as to be in parallel with the rail 18, together with a driving link piece 76 and a driven link piece 77, and always keeps to be in parallel with the longitudinal direction of the needle bed 2, that is, the direction of the rail 18. The parallelogram link can be displaced such that the operation bar 75 is attached to and detached from the carriage 3, by receiving a driving force from a motor 78 via a coupling link 79.

The coupling portion 17 on the side of the carriage 3 includes a coupling member 80. The coupling member 80 is provided with two stages of bringing recesses, that is, a deep bringing recess 81 and a shallow bringing recess 82. The deep bringing recess 81 is for ordinary knitting, and is shorter than the shallow bringing recess 82 for plating knitting. When the bringing pin 70 is not projected, the bringing pin 70 is not engaged with the coupling member 80, and thus the carriage 3 can move without bringing the moving member holding mechanism 15. When the bringing state switching mechanism 16 performs the switching to a state in which the moving member holding mechanism 15 is not brought by the carriage 3, the carriage 3 can move separately from the moving member holding mechanism 15 and the yarn feeder 6, and thus the mass of the carriage 3 when moving is reduced, so that the carriage 3 can move quickly.

Figure 11:
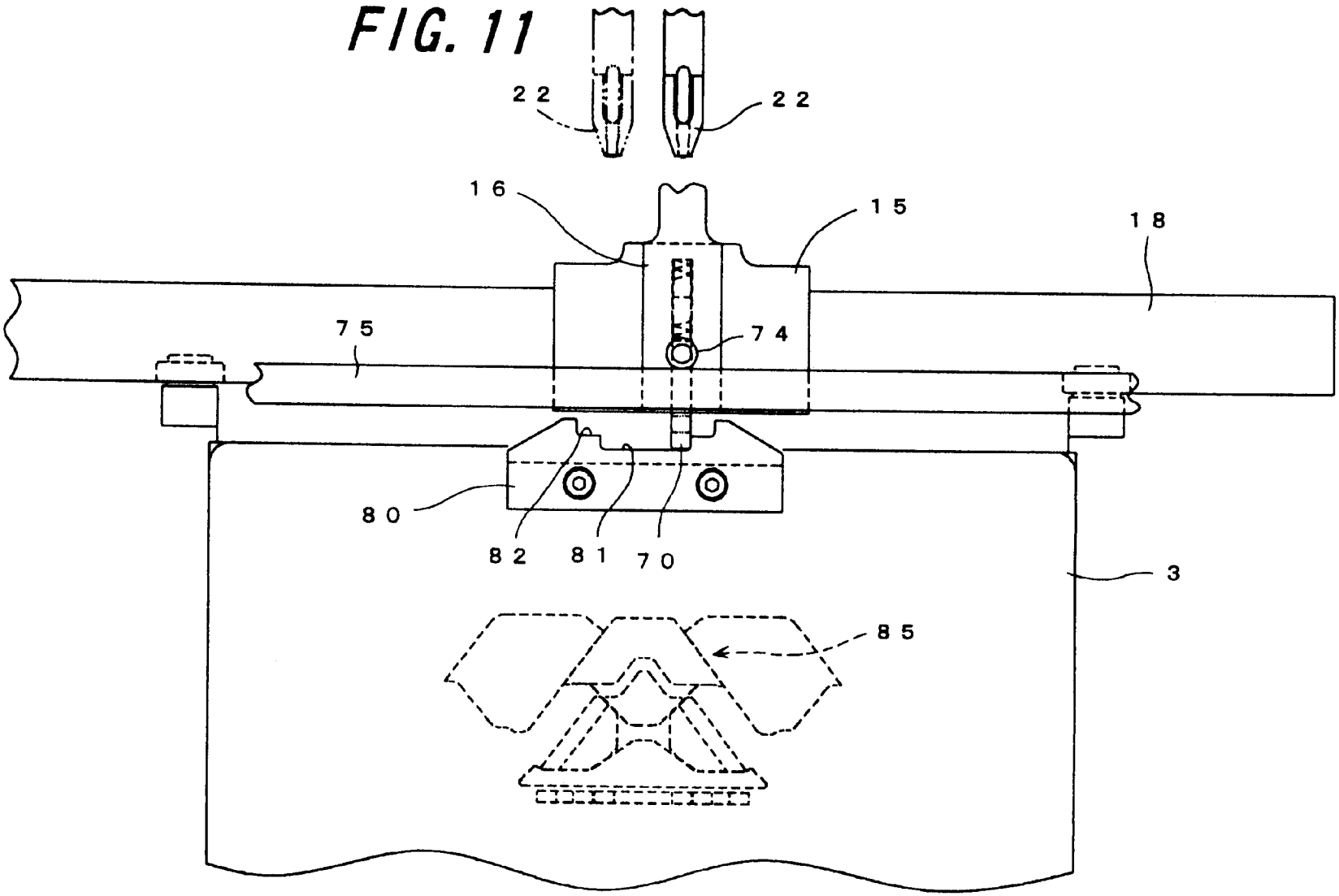
FIG. 11 is a front view showing a state in which a bringing pin 70 is engaged with a bringing recess 81 corresponding to ordinary knitting, when a carriage 3 in FIG. 1 is moved to the right.
Figure 12:
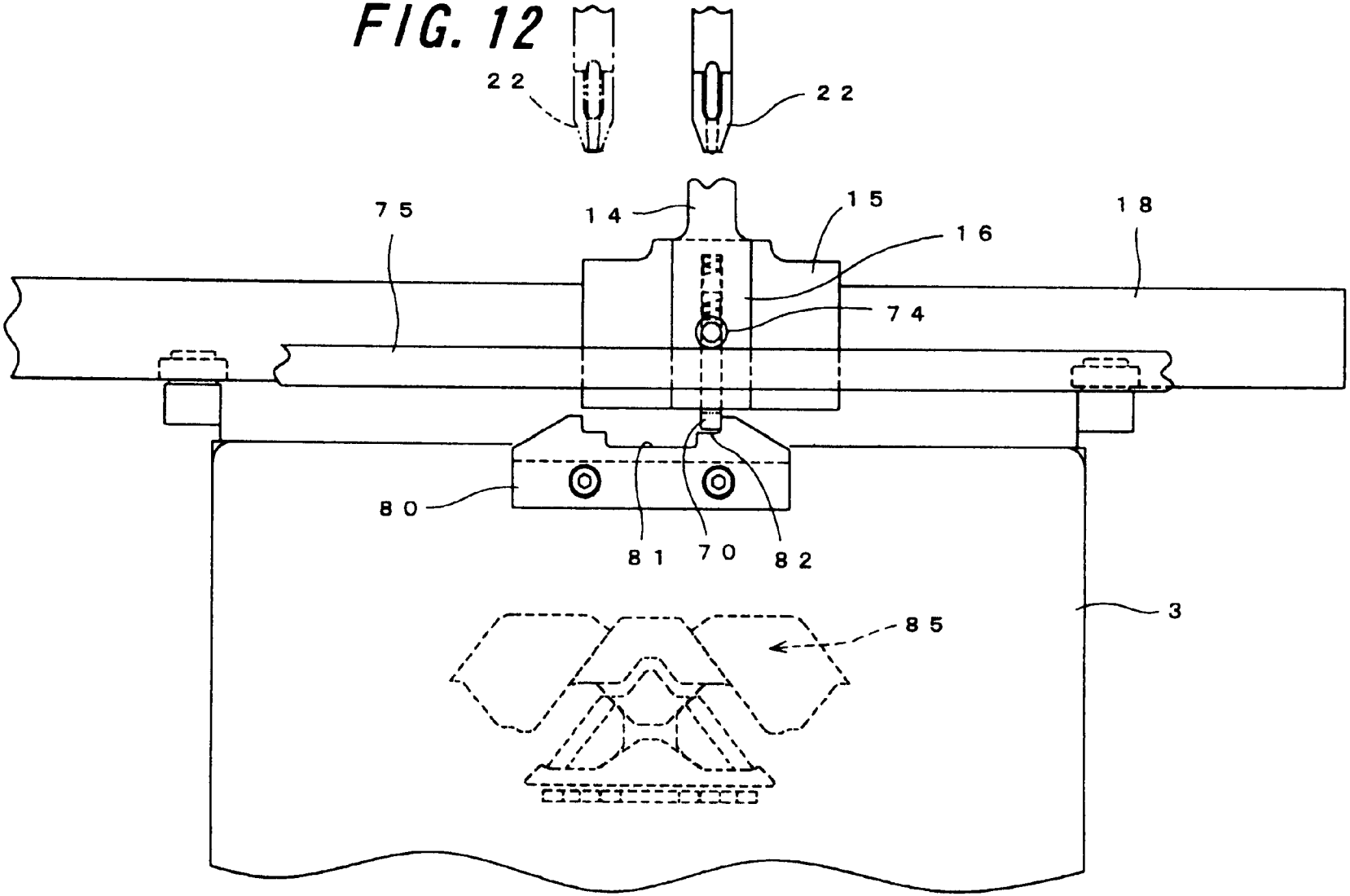
FIG. 12 is a front view showing a state in which the bringing pin 70 is engaged with a bringing recess 82 corresponding to plating knitting, when the carriage 3 in FIG. 1 is moved to the right.

FIGS. 11 and 12 show states in which the bringing recess 81 and the bringing recess 82 are respectively selected in a state where the carriage 3 in FIG. 1 is moved in the left. As shown in FIG. 11, when the amount by which the bringing pin 70 projects is increased, the bringing pin 70 is engaged with the deep bringing recess 81. The bringing recess 81 is formed such that the bringing position is shifted only by an amount corresponding to the yarn feeding position of the yarn feeding port 22 provided at a point midway in a process in which the knitting needle is withdrawn after the knitting needle has been moved forward into the needle bed gap 5 to the extent possible. A substantially mountain-shaped knitting cam 85 is mounted on the carriage 3, and thus the yarn feeding, position is the positions that are bilaterally-symmetric in the drawing, with respect to the center of the knitting cam 85, in accordance with a direction in which the carriage 3 moves. The length of the bringing recess 81 is led to correspond to the distance between the yarn feeding positions in both directions. As shown in FIG. 12, in plating knitting, with respect to the center of the knitting cam 85 on one of the front and rear carriages, a yarn is fed at the positions that are away from each other more than the yarn feeding positions for ordinary knitting on the opposed carriage on the other side shown in FIG. 11. When the amount by which the bringing pin 70 projects is led to match the shallow bringing recess 82, it is possible to increase the shifting of the bringing position in accordance with the length of the bringing recess 82.

Figure 13:
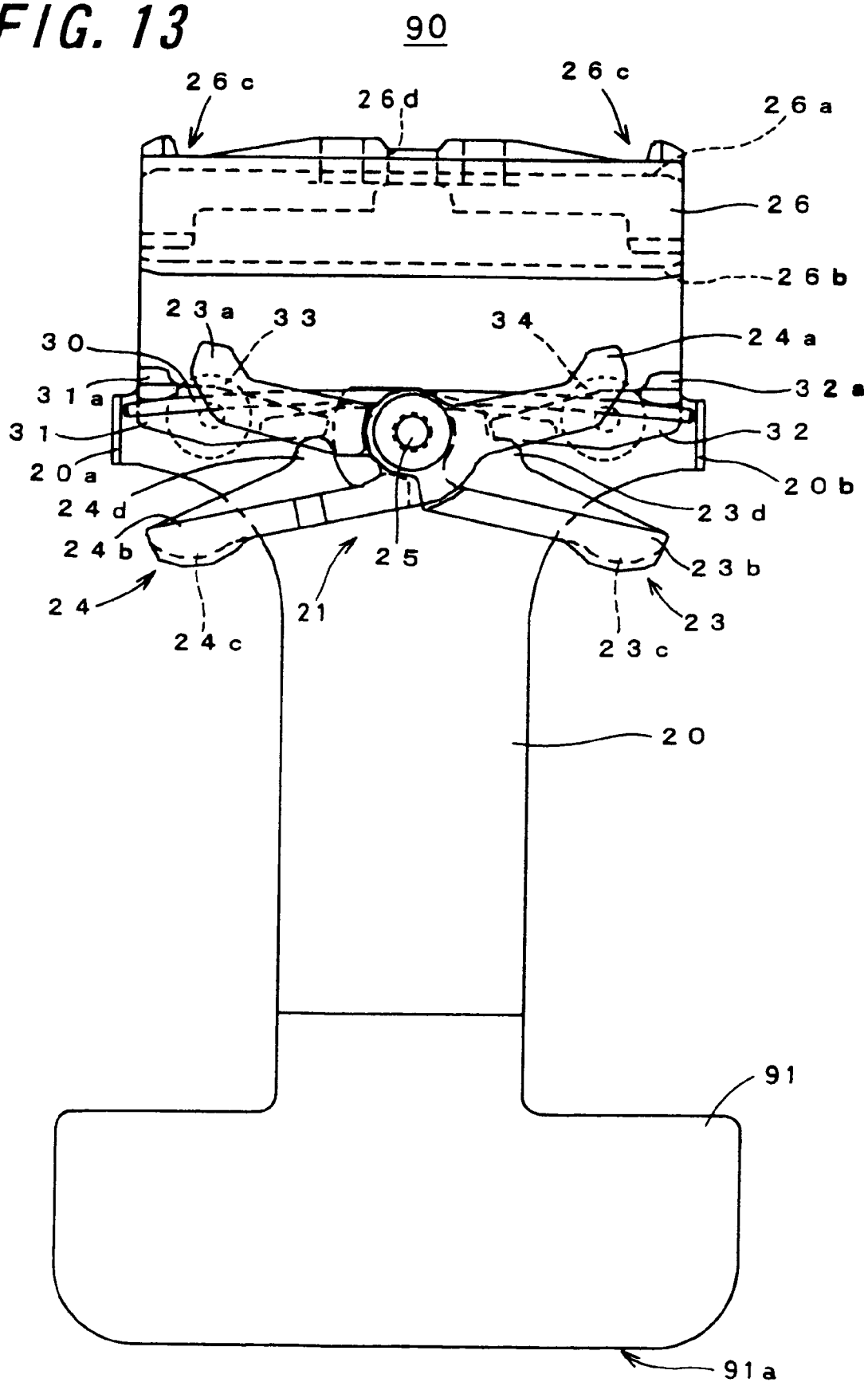
FIG. 13 is a front view showing a fabric presser 90 as a moving member for knitting according to another embodiment of the invention.

FIG. 13 shows a fabric presser 90 as a moving member for knitting according to another embodiment of the invention. In this embodiment, the components corresponding to those in the embodiment in FIG. 1 are denoted by the same reference symbols, and the repeated description thereof has been omitted. As the yarn feeder 6, the fabric presser 90 moves together with the holder 9 in a coupled manner. As the yarn feeder 6, the fabric presser 90 is mounted on and dismounted from the holder 9 with the hook mechanism 21.

The function of the fabric presser 90 is to prevent a knitting stitch from moving upward while a fabric is knitted. A fabric presser plate 91 is provided on the lower side on the fabric presser 90. The fabric presser plate 91 can prevent a knitting stitch from moving upward following the knitting needle, by acting on the rear face of the knitting needle moving upward into the needle bed gap and pressing the knitting stitch with an action face 91*a* at the front end.

The moving member for knitting such as the yarn feeder 6 and the fabric presser 90 can be mounted on and dismounted from the moving member holding mechanism 15 via the holder 9 and the holding arm 14. It should be noted that the moving member for knitting can be mounted and dismounted only when the carriage 3 has moved to the position of the stopping mechanism 11. When the switching is performed such that the moving member holding mechanism 15 is not brought by the carriage 3, by switching the amount by which the bringing pin 70 of the bringing state switching mechanism 16 projects in the embodiments, it is possible to separate the carriage 3 from the coupling mechanism switching mechanism 15 at any position. The moving member holding mechanism 15 that has been separated from the carriage 3 is stopped at the position that is determined in accordance with the moving speed at the time of separation and the sliding resistance received in the movement along the rail 18. When the bringing pin 70 is projected in the vicinity of the position at which the moving member holding mechanism 15 is stopped after the carriage 3 that has been separated from the moving member holding mechanism 15 continuously moves, the engagement between the bringing pin 70 and the coupling portion 18 is formed again, and thus the moving member holding mechanism 15 can be brought by the carriage 3.

Figure 14:
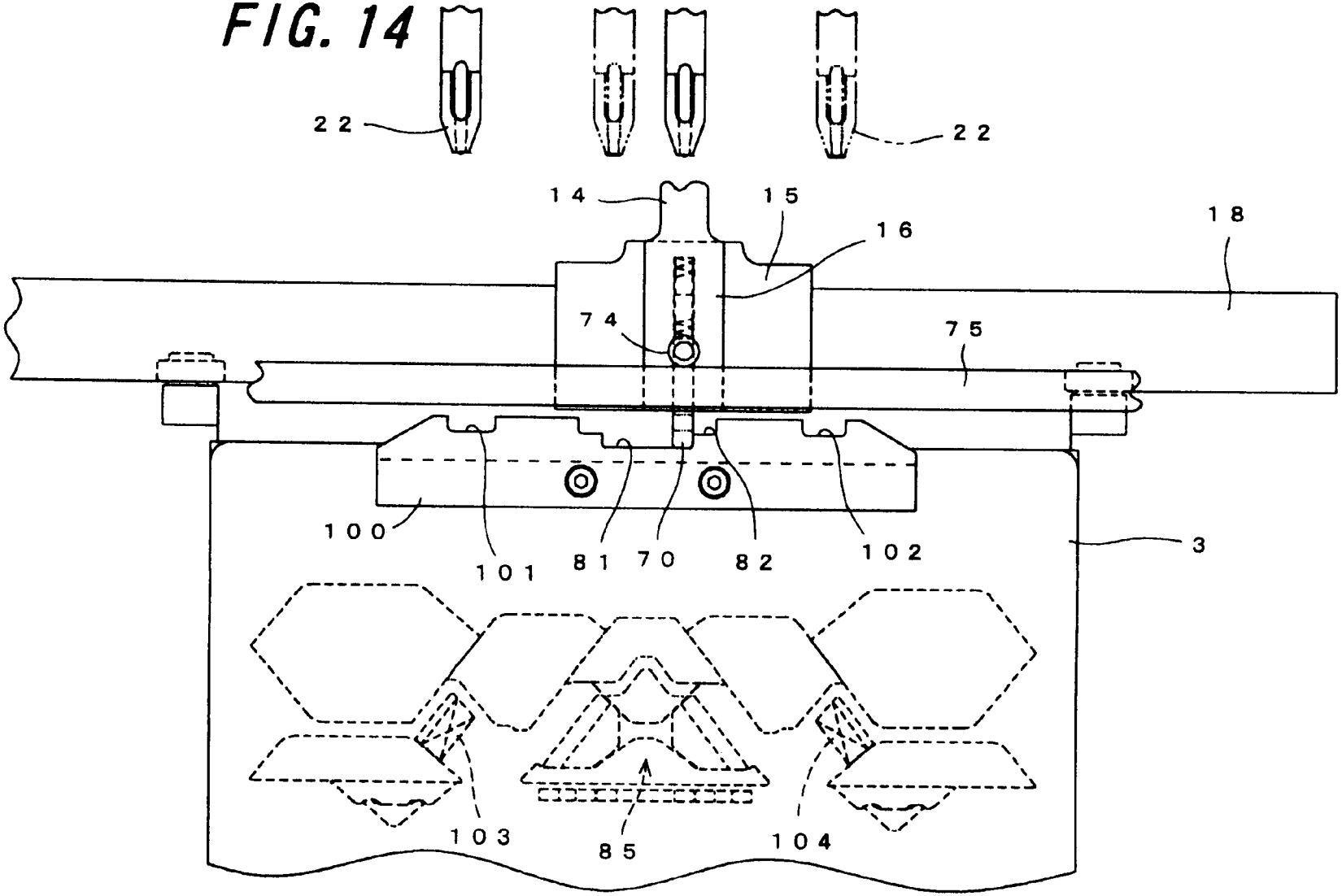
FIG. 14 is a schematic front view showing a configuration having bringing recesses 101 and 102 for inlay knitting as still another embodiment of the invention.

FIG. 14 shows a schematic configuration as still another embodiment of the invention. In this embodiment, the components corresponding to those in the embodiment in FIG. 1 are denoted by the same reference symbols, and the repeated description thereof has been omitted. In this embodiment, two stages of bringing recesses 81 and 82 as in the bringing member 80 in FIG. 10 are provided and bringing recesses 101 and 102 for inlay knitting are formed on a bringing member 100. When these plurality of recesses 81 and 82; 101 and 102 are formed, the bringing member 100 becomes long, but it is possible to easily provide the yarn feeding position for inlay knitting using the yarn feeder 6 for ordinary knitting. When rubber cams 103 and 104, which are rib stitch cam, are provided on the carriage 3, a knitting yarn for inlay knitting can be fed before a knitting yarn for ordinary knitting is fed. The yarn feeder 6 for inlay knitting and the yarn feeder 6 for ordinary knitting are away from each other on the opposite sides with respect to the center of the knitting cam 85, and thus the yarn feeders 6 do not interfere with each other at the needle bed gap, and thus an elastic yarn for inlay knitting and a knitting yarn for ordinary knitting can be used for knitting in the same course by using the yarn feeders 6 at the same time.

In the embodiments described above, the bringing pin 70 of the bringing state switching mechanism 16 is driven with the parallelogram link provided on the side of the needle bed 2, but it goes without saying that the bringing pin 70 can be driven with other mechanisms. For example, a displacement mechanism using a step motor as the driving source may be mounted on the bringing state switching mechanism 16. However, when the driving is performed with the motor 78 on the side of the needle bed 2, it is possible to make the bringing state switching mechanism 16 lighter and smaller.

Furthermore, the coupling state between the bringing state switching mechanism 16 and the coupling portion 17 is not limited to a state formed when the coupling pin 70 is engaged with the bringing recess 81 and 82; 101 and 102, but the coupling state may be also made by other means such as electromagnetic adhesion. Furthermore, the bringing state switching mechanism 16 may be mounted on the carriage 3. However, in a case where a large number of cam mechanisms such as the knitting cam 85 are mounted on the carriage 3 and it is required to make the carriage 3 smaller, it is more preferable to provide the bringing state switching mechanism 16 on the side of the moving member holding mechanism 15.

Figure 15:
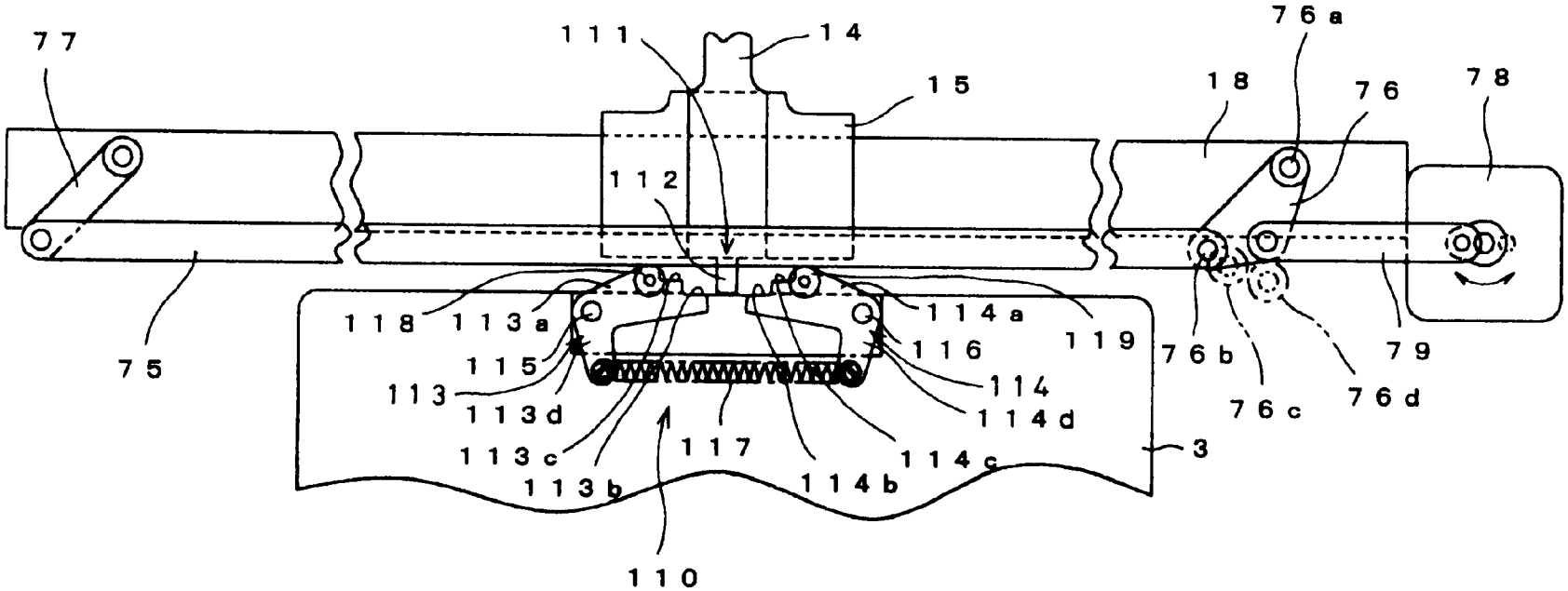
FIG. 15 is a front view outlining a configuration relating to a bringing state switching mechanism 110 and a coupling portion 111 as yet still another embodiment of the invention.

FIG. 15 outlines a configuration relating to a bringing state switching mechanism 110 and a coupling portion 111 in yet still another embodiment of the invention. The components corresponding to those in the configuration shown in FIG. 10 are denoted by the same reference symbols, and the repeated description thereof has been omitted. As in the embodiments described above, the bringing state switching mechanism 110 may be provided on the side of either the carriage 3 or the moving member holding mechanism 15, and when the bringing state switching mechanism 110 is provided on either one side, it suffices to provide the coupling portion 111 on the other side. In this embodiment, as the coupling portion 111 that is provided on the side of the moving member holding mechanism 15, a fixed bringing pin 112 that projects toward the carriage 3 only by a constant amount is provided. On the bringing state switching mechanism 110 that is provided on the carriage 3, a bringing recess that is to be engaged with the bringing pin 112 is formed between a pair of swinging members 113 and 114. The swinging members 113 and 114 are substantially L-shaped, and can be swingingly displaced around swinging shafts 115 and 116 that are provided at bending portions in the substantially middle portions. The swinging members 113 and 114 have arms 113*a* and 114*a* that opposingly extend closer to each other from the swinging shafts 115 and 116. Stage portions 113*b* and 113*c*; 114*b* and 114*c* are formed at the front ends of the arms 113*a* and 114*a* that are opposed to each other. Bringing recesses that can be engaged with the bringing pin 112 can be formed between the stage portion 113*b* and the stage portion 114*b*, and between the stage portion 114*b* and the stage portion 114*c*. A spring 117 biases between the front ends of arms 113*d* and 114*d* that are different from the arms 113*a* and 114*a* provided with the stage portions 113*b* and 113*c*; 114*b* and 114*c*, with respect to the swinging shafts 115 and 116, on the swinging members 113 and 114 such that the arms 113*d* and 114*d* move closer to each other. Rollers 118 and 119 are provided such that the rollers 118 and 119 can rotate at the positions closer to the swinging shafts 115 and 116 than the stage portions 113*c* and 114*c* on the arms 113*a* and 114*a*.

The spring 117 biases the swinging members 113 and 114 so as to be swingingly displaced around the swinging shaft 115. The arm 113*a* is biased counter-clockwise and the arm 114*a* is biased clockwise. As a result, the stage portions 113*b* and 113*c*; 114*b* and 114*c* at the front ends of the arms 113*a* and 114*a* are biased so as to project toward the moving member holding mechanism 15. The rollers 118 and 119 are positioned to project toward the moving member holding mechanism 15 more than the stage portions 113*b* and 113*c*; 114*b* and 114*c*. The rollers 118 and 119 abut against the operation bar 75. The swinging displacement of the swinging members 113 and 114 with a biasing force of the spring 117 is regulated by the rollers 118 and 119 abutting against the operation bar 75. The operation bar 75 forms a parallelogram link, so as to be in parallel with the rail 18, together with the driving link piece 76 and the driven link piece 77, and always keeps to be in parallel with the longitudinal direction of the needle bed 2, that is, the direction of the rail 18. The parallelogram link can be displaced such that the operation bar 75 is attached to and detached from the carriage 3, by receiving a driving force from the motor 78 via the coupling link 79. More specifically, a state how the swinging pieces 113 and 114 are swingingly displaced can be changed in accordance with the spacing between the operation bar 75 and the carriage 3 based on angular displacement of the output shaft of the motor 78.

In the state shown in FIG. 15, the driving link 76 has been swingingly displaced clockwise to the extent possible around a swinging shaft 76*a* at the upper end. When the motor 78 performs angular displacement in any direction, the driving link 76 performs angular displacement counter-clockwise around the swinging shaft 76*a*, and the operation bar 75 moves closer to the carriage 3. Thus, in a state of a coupling portion 76*b* of the driving link 76 with respect to the operation bar 75 as indicated by the solid line in the drawing, the operation bar 75 has moved away from the carriage 3 to the extent possible. In this state, the stage portions 113*b* and 114*b* of the swinging members 113 and 114 are opposed to each other and form a bringing recess that is to be engaged with the bringing pin 112. After the motor 78 performs angular displacement and the operation bar 75 moves closer to the carriage, in a state of a coupling portion 76*c* indicated by the phantom line in the drawing, the rollers 118 and 119 are pressed down by the operation bar 75, and the swinging members 113 and 114 are swingingly displaced around the swinging shafts 115 and 116, and thus the stage portions 113*c* and 114*c* form a bringing recess that is to be engaged with the bringing pin 112. When reaching the lower limit position shown as a coupling portion 76*c* of the driving link 76 as indicated by the phantom line in the drawing after the motor 78 further performs angular displacement, the rollers 118 and 119 are pressed down by the operation bar 75 to the position closer to the carriage 3 than the front end of the bringing pin 112. In this state, a bringing recess that is to be engaged with the bringing pin 112 is not formed on the bringing state switching mechanism 110, and thus the state has been switched to a state in which the moving member holding mechanism 15 is not brought by the carriage 3.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to the invention, a rail, a stopping mechanism, a moving member holding mechanism, and a bringing state switching mechanism are provided in order to make it possible to switch a bringing state of a moving member for knitting that moves while being brought by a carriage that, while moving along needle beds of a weft knitting machine, lets knitting needles arranged side by side on the needle beds perform a knitting operation, and that knits a fabric in cooperation with the knitting needles. The end portion of the rail that is provided along the needle beds is provided with the stopping mechanism that can stop the moving member for knitting. The moving member holding mechanism can move back and forth on the rail, and the stopping mechanism can attach the moving member for knitting to the moving member holding mechanism and detach the moving member for knitting from the moving member holding mechanism when the moving member holding mechanism moves to a position of the stopping mechanism. The bringing state switching mechanism is capable of switching, with respect to the carriage, between a state in which the moving member holding mechanism is brought by the carriage and a state in which the moving member holding mechanism is not brought are provided. When the bringing state switching mechanism performs the switching to a state in which the moving member holding mechanism is not brought by the carriage, the carriage can move separately from the moving member holding mechanism and the moving member for knitting, and the mass of the carriage when moving is reduced, so that the carriage can move quickly. When the bringing state switching mechanism performs the switching to a state in which the moving member holding mechanism is brought by the carriage, it is possible to knit a fabric by bringing the moving member for knitting in a state where the moving member for knitting is held by the moving member holding mechanism. For example, when performing stitch transfer, it is possible to stop the moving member holding mechanism at an appropriate position by separating the moving member holding mechanism, without moving the carriage to the position of the stopping mechanism. Furthermore, it is possible to switch the moving members for knitting between the moving member holding mechanisms for the front and rear carriages without moving the carriages to the positions of the stopping mechanisms, an thus in a case where pattern knitting is performed for fingers of gloves and other portions by switching knitting yarns, for example, it is possible to perform knitting efficiently by bringing the moving member holding mechanisms in a state where the yarn feeders are held by the moving member holding mechanisms to the vicinity of a knitting area with a small width, and by switching the bringing of the front and rear moving member holding mechanisms at the positions. It is possible to switch the bringing state of the moving members for knitting as appropriate by switching between the bringing and the non-bringing. The moving members for knitting can be attached to and detached from the moving member holding mechanisms by the stopping mechanisms, and thus it is also possible to change the moving members for knitting.

Furthermore, according to the invention, the bringing state switching mechanisms switch the moving member holding mechanisms in which the bringing positions with respect to the carriages are different from each other between the front and rear moving member holding mechanisms when the carriages move back and forth along the needle beds, and thus it is possible to perform plating knitting by making the timings at which knitting yarns are fed using the front and rear moving member holding mechanisms different from each other. Furthermore, it is possible to switch the yarn feeders that are held by the front and rear moving member holding mechanisms, and thus it is possible to perform various types of plating knitting while changing knitting yarns.

Furthermore, according to the invention, an operation bar that is provided along the rail, and that can be displaced in a direction different from a direction along the rail, and a displacement driving mechanism for displacing the operation bar in the direction different from the direction along the rail are provided. The bringing state switching mechanism controls an actuation state of the control member in conjunction with a displacement of the operation bar in a direction that is different from the direction along the rail, and thus it is possible to switch the bringing state between the moving member holding mechanism and the carriage, by controlling the operation bar.

Furthermore, according to the invention, when the control member projects in actuation, the control member abuts against a recess portion of the bringing member, and thus the moving member holding mechanism can be brought at bringing positions that are different from each other in accordance with a direction in which the carriage moves.

Furthermore, according to the invention, when the control member projects at bringing positions that are different from each other in accordance with a direction in which the carriage moves, the control member abuts against a protrusion portion of the bringing member, and thus the moving member holding mechanism can be brought by the carriage.

What is claimed is:

1. A weft knitting machine capable of switching a state of bringing a moving member for knitting which moves while being brought by at least one of front and rear carriages, and while the carriages move along front and rear needle beds of the weft knitting machine, knitting needles are arranged side by side in each of the needle beds to perform a knitting operation, the moving member for knitting a fabric in cooperation with the knitting needles, comprising:

a rail that is disposed along the needle beds;

a stopping mechanism that is disposed at an end portion of the needle beds, and that can stop the moving member for knitting;

a moving member holding mechanism that can move back and forth on the rail, the stopping mechanism being capable of attaching the moving member for knitting to the moving member holding mechanism and detaching the moving member for knitting from the moving member holding mechanism when the moving member holding mechanism moves to a position of the stopping mechanism; and a bringing state switching mechanism capable of switching between a state in which the moving member holding mechanism is brought by the carriage and a state in which the moving member holding mechanism is not brought.

2. The weft knitting machine of claim 1, wherein the bringing state switching mechanism is provided on each of the front and rear carriages, and the bringing state switching mechanisms can provide positions different from each other between the front and rear carriages.

3. The weft knitting machine of claim 1, wherein the bringing state switching mechanism includes:

a control member that is provided on either one of the moving member holding mechanism and the carriage, and that can control an actuation state between actuation and non-actuation, a bringing member that is provided on the other one of the moving member holding mechanism and the carriage, and that can be brought at positions that are different from each other in accordance with a direction in which the carriage travels when the control member is actuated, and cannot be brought when the control member is not actuated, an operation bar that is provided along the rail, and that can be displaced in a direction different from a direction along the rail, and a displacement driving mechanism for displacing the operation bar in the direction different from the direction along the rail, and wherein the bringing state switching mechanism controls the actuation state of the control member in conjunction with a displacement of the operation bar in the direction different from the direction along the rail, and performs switching of the positions of the moving member holding mechanism with respect to the carriage and switching to a state in which the moving member holding mechanism is not brought.

4. The weft knitting machine of claim 1, wherein the actuation state of the control member can be controlled such that the control member projects toward the bringing member in the actuation, and does not project toward the bringing member in the non-actuation, and the bringing member has a recess portion that abuts against the control member projecting in the actuation at positions that are different from each other in accordance with a direction in which the carriage moves.

5. The weft knitting machine of claim 1, wherein the actuation state can be controlled such that the control member projects toward the bringing member in the actuation at positions that are different from each other in accordance with a direction in which the carriage moves, and does not project toward the bringing member in the non-actuation, and the bringing member has a protrusion portion that abuts against the control member projecting in the actuation.

* * * * *